US007118426B2

(12) United States Patent
Nakamura

(10) Patent No.: US 7,118,426 B2
(45) Date of Patent: Oct. 10, 2006

(54) CONNECTOR WITH REINFORCED RETAINER MOUNT HOLE

(75) Inventor: Hideto Nakamura, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/044,244

(22) Filed: Jan. 27, 2005

(65) Prior Publication Data

US 2005/0170703 A1 Aug. 4, 2005

(30) Foreign Application Priority Data

Feb. 2, 2004 (JP) ..... 2004-025128

(51) Int. Cl.
*H01R 13/514* (2006.01)

(52) U.S. Cl. ..... 439/752; 439/595

(58) Field of Classification Search ..... 439/752, 439/731, 436, 595, 752.5
See application file for complete search history.

(56) References Cited

U.S. PATENT DOCUMENTS 5,746,628 A 5/1998 Yamamoto ..... 439/752
6,589,083 B1 * 7/2003 Kobayashi et al. ..... 439/752
6,659,811 B1 * 12/2003 Okamoto et al. ..... 439/752
6,878,018 B1 * 4/2005 Miyakawa et al. ..... 439/752

* cited by examiner

*Primary Examiner*—Michael C. Zarroli
(74) *Attorney, Agent, or Firm*—Gerald E. Hespos; Anthony J. Casella

(57) ABSTRACT

A female housing (10) is formed with a retainer mount hole (11) communicating with cavities (14) into which female terminal fittings (50) are insertable while crossing the cavities (14). The retainer mount hole (11) makes an opening from the upper surface of the female housing (10) to the opposite side surfaces thereof, and a retainer (40) is inserted through one of the opposite side surfaces. Reinforcements (20) are provided on the upper surface of the female housing (10) to cross over the opening of the retainer mount hole (11) in a direction intersecting with the opening. The reinforcements (20) are behind pressing portions (13) and arranged on planes of projection of the pressing portions (13) when viewed from the front.

16 Claims, 12 Drawing Sheets

CONNECTOR WITH REINFORCED RETAINER MOUNT HOLE

BACKGROUND OF THE INVENTION

1. Field of the Invention

The invention relates to a connector with a retainer.

2. Description of the Related Art

U.S. Pat. No. 5,746,628 discloses a connector with a housing made of a synthetic resin. Cavities are formed in the housing and terminal fittings are accommodated in the cavities. A retainer mount hole is formed in a side surface of the housing and communicates with the cavities. A retainer is insertable into the retainer mount hole along a direction normal to the terminal inserting direction. The retainer initially is at a partial locking position where the retainer is retracted from the cavities to permit the insertion and withdrawal of the terminal fittings. However, the retainer can be moved to a full locking position where a portion of the retainer is in the cavities and engaged with jaws at the rear ends of the properly inserted terminal fittings to retain the terminal fittings in the cavities.

A demand exists for a shorter connector. The above-described connector can be shortened by reducing the thickness of the upper and lower walls. However, this thinning may require the retainer mount hole to open in three adjacent surfaces of the housing, e.g. upper wall and opposite side walls. A housing that is open at three adjacent surfaces is not strong and the entire housing may be resiliently deformable.

The invention was developed in view of the above problem and an object thereof is to provide a strong housing with a retainer mount hole.

SUMMARY OF THE INVENTION

The invention relates to a connector with a housing that has at least one cavity for receiving a terminal fitting. A retainer mount hole communicates with and crosses the cavities. A retainer is insertable into the retainer mount hole to retain the terminal fittings in the cavities. The retainer mount hole is open in two surfaces of the housing that substantially face each other, and one adjacent surface. The adjacent surface preferably is orthogonal to the two facing surfaces. A reinforcement is provided on the adjacent surface to cross the opening of the retainer mount hole. The reinforcement improves the rigidity of the housing.

The housing preferably can fit into a receptacle of a mating housing. The mating housing preferably has a slider that is movable along connecting and separating directions of the two housings. The slider preferably has a pressable portion exposed at an inner surface of the receptacle.

A biasing means preferably is disposed to accumulate a biasing force for separating the housings. One end of the biasing means preferably is supported on the pressable portion. A pressing portion preferably projects from the housing, and can press the pressable portion in the process of connecting the housings. The pressing portion and the pressable potion preferably are freed from the pressed state by a disengagement guide in the mating housing. Simultaneously, the slider is permitted to release the biasing force of the biasing means.

The pressing portion and the reinforcement preferably are arranged one after the other along the connecting direction of the housings.

The reinforcement preferably is on a plane of projection of the pressing portion when viewed from the front with respect to the connecting direction of the housings.

The pressing portion engages the pressable portion of the slider in the process of fitting the housing into the receptacle. Their may be apprehension that the reinforcement will interfere with the opening edge and the inner surface of the receptacle. However, the reinforcement and the pressing portion are arranged one after the other along the connecting direction and/or the reinforcement is on the plane of projection of the pressing portion when viewed from front with respect to the connecting direction. Thus, interference is avoided and a dead space of the housing is utilized efficiently.

The pressing portions preferably are hidden behind the reinforcements in the connecting process when viewed from front. Thus, the pressing portions cannot interfere with an opening edge or an inner surface of the receptacle.

The pressable portion preferably is fit between the reinforcement and the pressing portion when the housings are connected properly.

The invention also relates to a connector assembly comprising the above described connector and a mating connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is illustrated in FIGS. 1 to 16. The connector has female and male housings 10, 30 connectable with each other along a connecting direction CD. In the following description, sides of the housings 10, 30 to be connected with each other are referred to as front side.

Figure 12A:
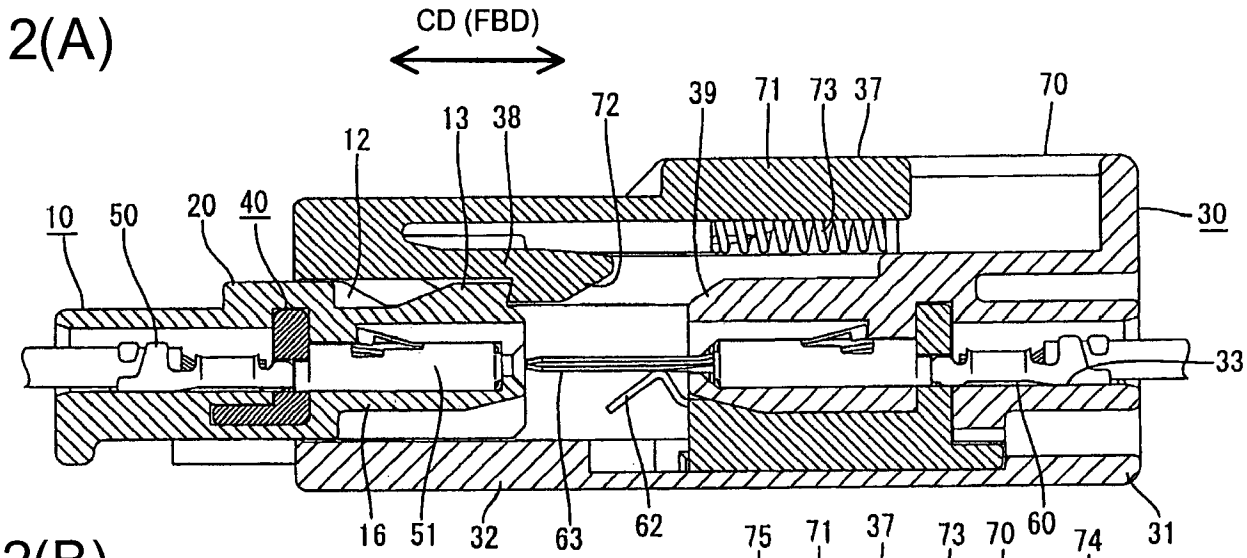
FIG. 12(A) is a side view in section showing a state where pressing portions are held in contact with pressable portions and FIG. 12(B) is a side view in section showing an intermediate state of the connection of the two housings.
Figure 12B:
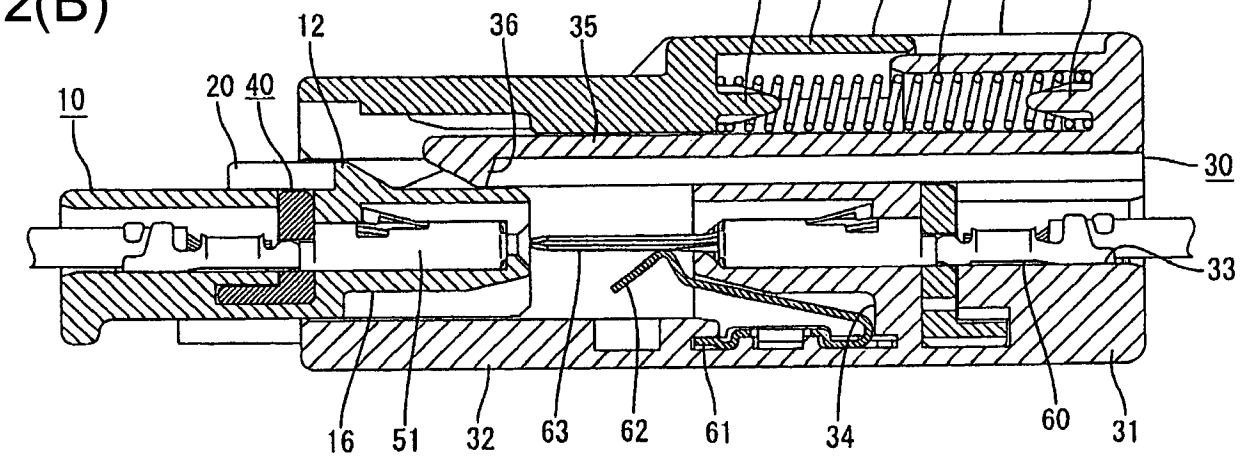

The male housing 30 is made unitarily e.g. of a synthetic resin and, as shown in FIG. 12(B), has a terminal accommodating portion 31. A receptacle 32 projects forward from the terminal accommodating portion 31 and has an open front configured for receiving the female housing 10. Cavities 33 penetrate the terminal accommodating portion 31 in forward and backward directions FBD substantially parallel to the connecting direction CD, and male terminal fittings 60 are insertable into the cavities 33 from behind. A shorting-terminal accommodating chamber 34 is formed adjacent the cavities 33 in the terminal accommodating portion 31 for accommodating a shorting terminal 61. The shorting terminal 61 includes two resilient contacts 62 that project towards the receptacle 32 for resiliently contacting the lateral surfaces of tabs 63 of the male terminal fittings 60 to short two corresponding male terminal fittings 60.

A resiliently deformable lock arm 35 is cantilevered from a widthwise middle of an upper part of the receptacle 32. A lock projection 36 is formed at the front end of the lower surface of the lock arm 35.

Portions of the receptacle 32 at opposite sides of the lock arm 35 are cut away, as shown in FIG. 12(A), and disengagement guides 39 are provided at opposite sides of the lock arm 35 in an upper end portion of the terminal accommodating portion 31.

The connector further includes a slider 37 made e.g. of a synthetic resin and assembled into a unit 70. This slider 37 includes a substantially flat main body 71 that is long in forward and backward directions FBD. The main body 71 mounted in the unit 70 for movement in forward and backward directions FBD while being held in sliding contact with the inner wall of the unit 70 and the upper wall of the receptacle 32. Pressable arms 38 project from the opposite lateral edges of a front end portion of the lower surface of the main body 71. The pressable arms 38 project back and are resiliently deformable with their base ends at the front as supports. A substantially hook-shaped pressable portion 72 projects down from the free end of each pressable arm 38 and faces an inner side surface of the receptacle 32. The front surface of each pressable portion 72 is sloped up and out toward the back.

At least one compression coil spring 73 is assembled into the unit 70. One end of the spring 73 is supported on a spring holder 74 formed on the rear wall of the unit 70 and has the other end of the spring 73 is supported on a spring receiving portion 75 of the slider main body 71.

The female housing 10 is made unitarily e.g. of a synthetic resin and defines a substantially block shape, as shown in FIGS. 8 to 11. Three side-by-side cavities 14 penetrate the female housing 10 in forward and backward directions FBD and a locking groove 15 is formed in the ceiling surface of each cavity 14. Female terminal fittings 50 are insertable into the cavities 14 from behind. Each female terminal fitting 50 has a box-shaped main portion 51 configured for electrical connection with the corresponding male terminal fitting 60. A barrel 52 is formed behind the main portion 51 and is configured to be crimped, bent or folded into connection with an end of a wire W. A lock 53 is formed by making cuts in the main portion 51 and bending the cut portion out. The lock 53 is engageable with the back end surface of the locking groove 15. Freeing grooves 16 are formed below the cavities 14 in the female housing 10 and open in the front and bottom surfaces of the female housing 10. The resilient contact pieces 62 of the shorting terminal 61 in the male housing 30 are insertable into the freeing grooves 16, and are pushed down and away from the terminal fittings 60 by the peripheral edges of the freeing grooves 16.

Figure 9:
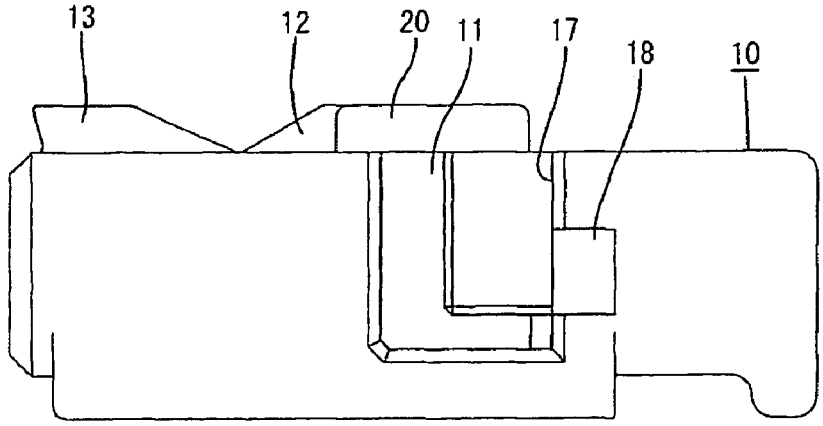
FIG. 9 is a right side view of the female housing.
Figure 10:
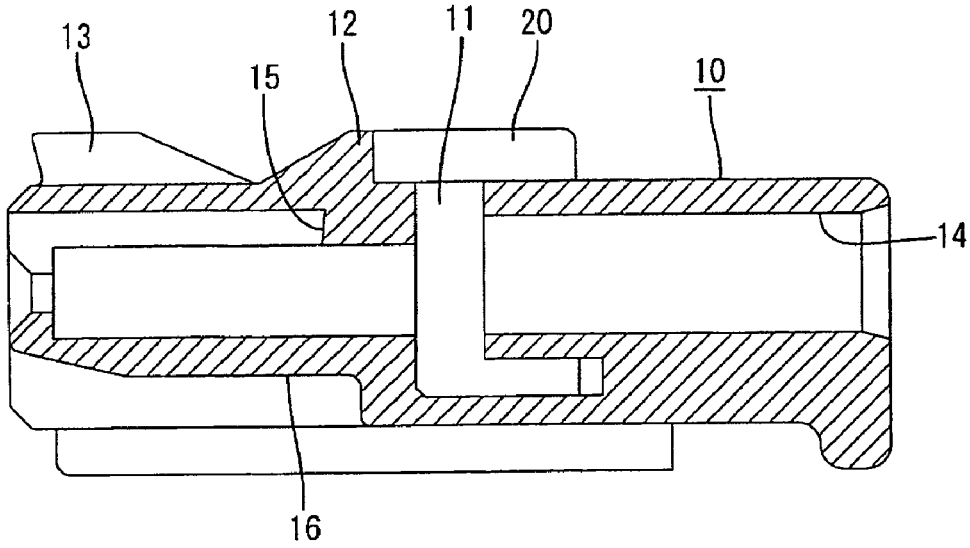
FIG. 10 is a side view in section of the female housing.
Figure 11:
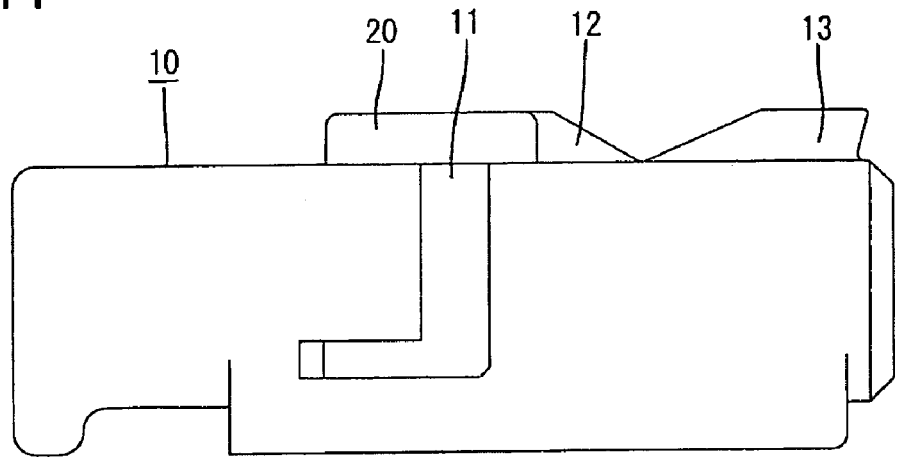
FIG. 11 is a left side view of the female housing.

Two pressing portions 13 project at the front end of the upper surface of the female housing 10 and are spaced apart along a width direction WD. The pressing portions 13 can press the respective pressable portions 72 of the slider 37. The front surfaces of the pressing portions 13 slope up and towards the front, as shown in FIG. 9, to define an undercut for pressing the pressable portions 72. The rear surfaces of the pressing portions 13 are sloped up and towards the front less steeply than the front surfaces thereof. A lock 12 projects behind the pressing portions 13 in the widthwise middle of the upper surface of the female housing 10 and is engageable with the lock arm 35 of the male housing 30. The front surface of the lock 12 slopes up towards the back to facilitate movement of the lock arm 35 onto the lock 12. However, the rear surface of the lock 12 is substantially vertical and normal to the connection direction CD for locked engagement with the lock arm 35.

A retainer mount hole 11 is formed in a longitudinal intermediate position of one side surface of the female housing 10 and intersects the respective cavities 14. A retainer 40 is insertable into the retainer mount hole 11 substantially along an inserting direction ID, which is also the width direction WD. The retainer 40 is movable between a partial locking position 1P (FIG. 7(A)) where insertion and withdrawal of the female terminal fittings 50 are permitted and a full locking position 2P (FIG. 7(B)) where the retainer 40 is engaged with jaws 54 at the rear ends of the main portions 51 to lock the female terminal fittings 50.

The retainer mount hole 11 extends from the upper surface to the opposite side surfaces of the female housing 10, and hence is open in three surfaces. The opposite side surfaces of the female housing 10 form two surfaces facing each other along an inserting direction ID of the retainer 40, and the upper surface of the female housing 10 forms a substantially orthogonal adjacent surface.

The retainer mount hole 11 has a substantially L-shaped side view, as shown in FIG. 9, to conform to the cross sectional shape of the retainer 40. The retainer mount hole 11 has a large substantially rectangular opening 17 in one side surface of the female housing 10, and the retainer 40 has a pushable portion 41 that is fittable into the opening 17. A jig guiding surface 18 is formed at an opening edge of the opening 17. The retainer 40 can be withdrawn from the female housing 10 by letting an unillustrated jig slide on the jig guiding surface 18 to engage the mounted retainer 40.

Figure 7A:
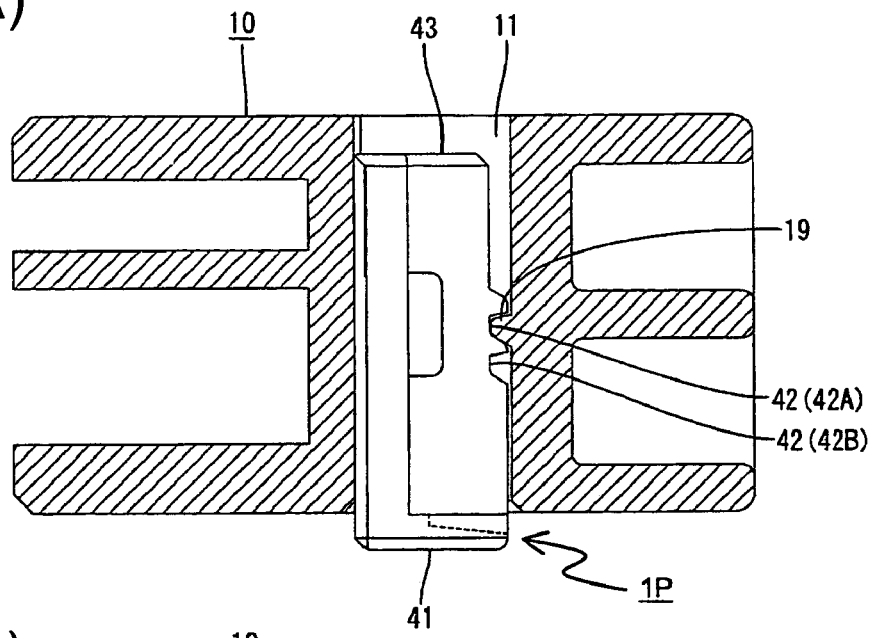
FIG. 7(A) is a horizontal section showing a state where the retainer is held at a partial locking position and FIG. 7(B) is a horizontal section showing a state where the retainer is held at a full locking position.
Figure 7B:
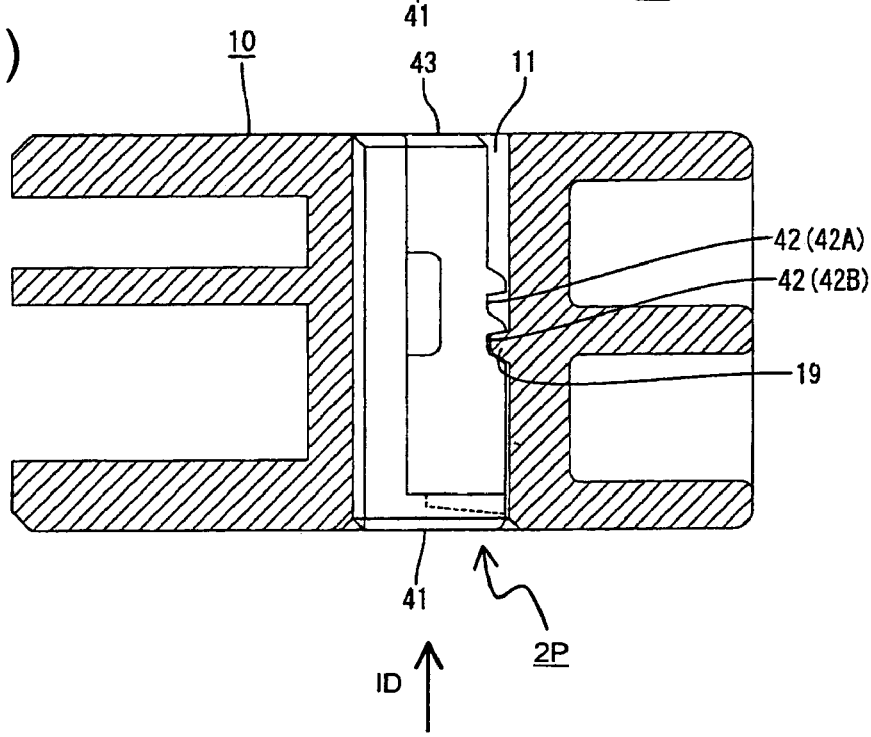
Figure 8:
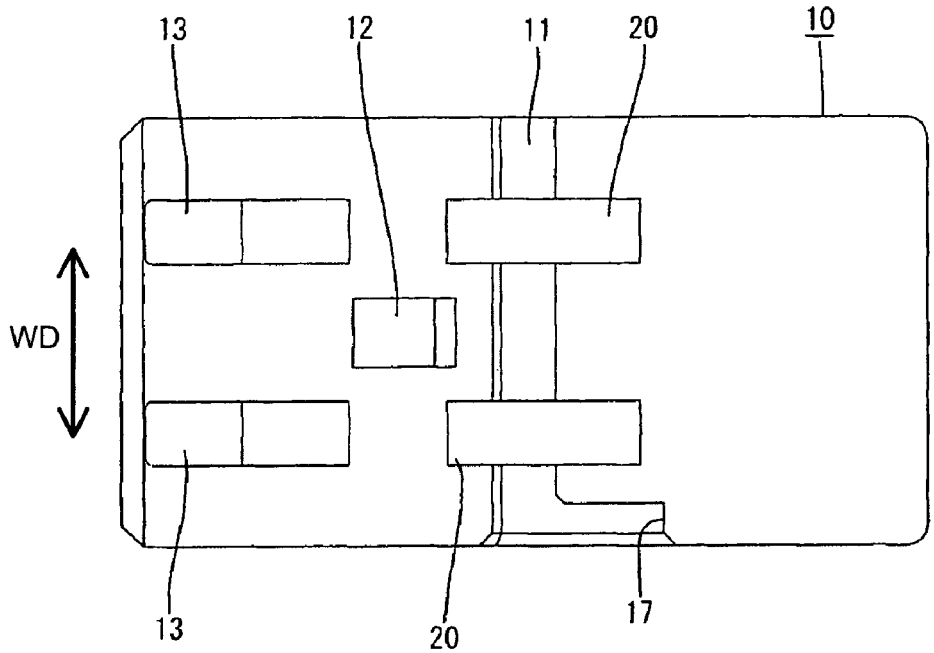
FIG. 8 is a plan view of the female housing.

As also shown in FIG. 7(A), an engaging protrusion 19 is provided on the edge of the retainer mount hole 11 in the female housing 10. The engaging protrusion 19 is engageable with respective receiving portions 42 of the retainer 40. The retainer 40 can be held at the partial locking position 1P and the full locking position 2P by the engagement of the receiving portions 42 and the engaging protrusion 19. The engaging protrusion 19 has a guiding surface facing a side from which the retainer 40 is inserted to facilitate movement of the retainer 40 from the partial locking position 1P to the full locking position 2P.

Figure 4:
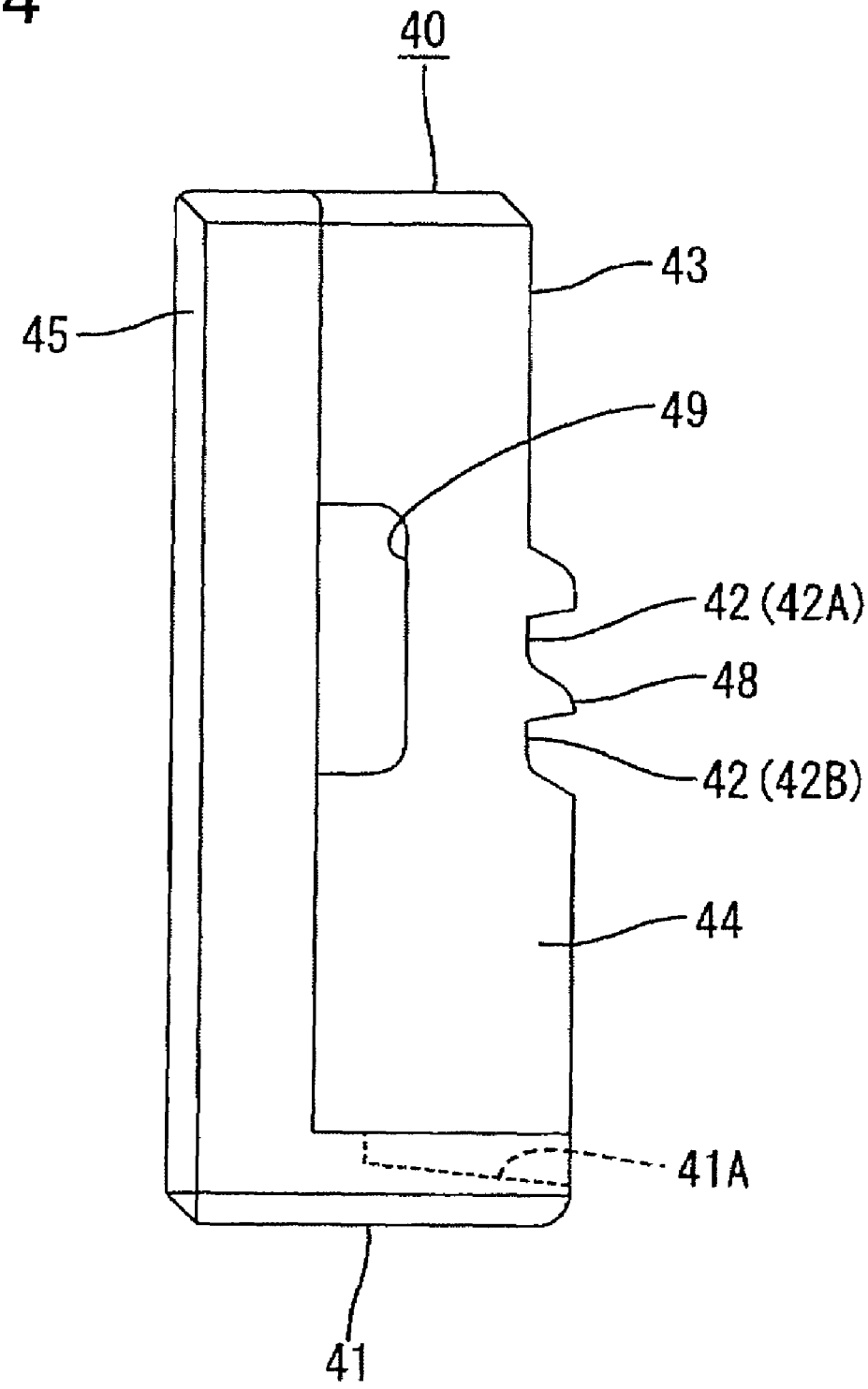
FIG. 4 is a plan view of a retainer.
Figure 5:
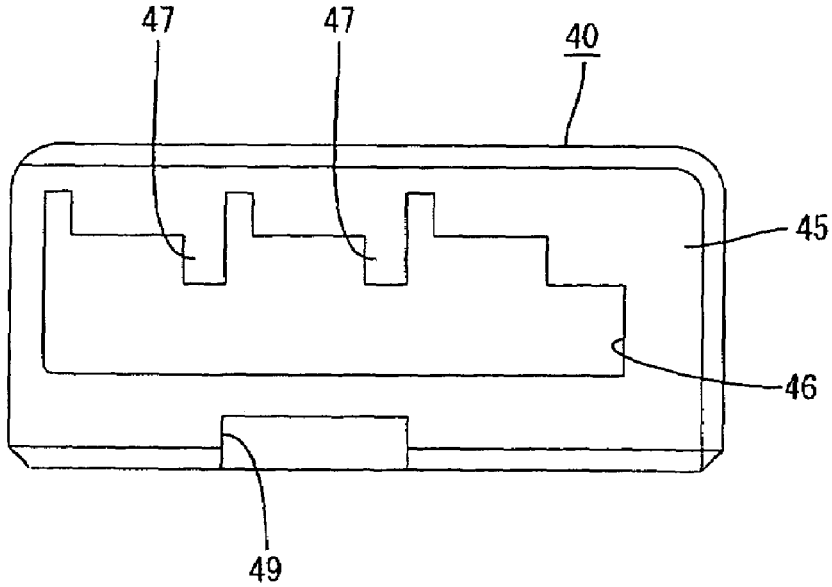
FIG. 5 is a front view of the retainer.
Figure 6:
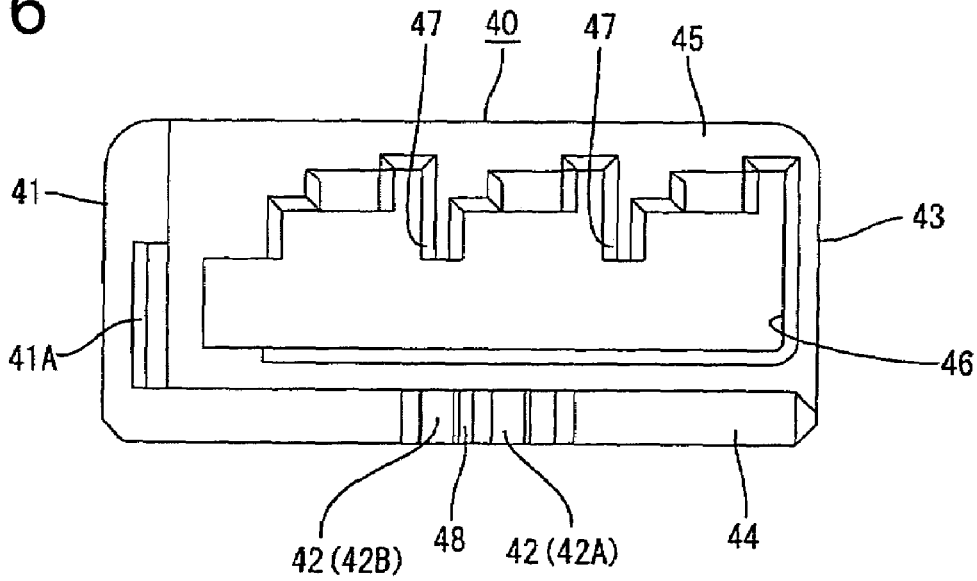
FIG. 6 is a rear view of the retainer.

The retainer 40 is made unitarily e.g. of a synthetic resin and has a pushable portion 41. An inserting portion 43 extends perpendicularly from the pushable portion 41 and has a length corresponding to the width of the female housing 10 along the inserting direction ID, as shown in FIGS. 4 to 6. The inserting portion 43 has an L-shaped cross-section defined by a bottom wall 44 and a standing wall 45 that projects up from the front of the bottom wall 44. The standing wall 45 is arranged to cross the cavities 14 and has a bored portion 46 corresponding to the cavities 14. Locks 47 project down from the upper edge of the bored portion 46 and for engaging the jaws 54 of the female terminal fittings 50. The locks 47 are retracted sideways from the cavities 14 when the retainer 40 is at the partial locking position 1P to permit insertion and withdrawal of the female terminal fittings 50. However, the locks 47 enter the cavities 14 to lock the female terminal fittings 50 when the retainer reaches the full locking position 2P.

Receiving recesses 42A, 42B are formed at the rear edge of the bottom wall 44 and are spaced apart along the width direction WD. The receiving recesses 42A, 42B are shaped to correspond to the engaging protrusion 19 of the female housing 10. The receiving recess 42A is at a front side with respect to the inserting direction ID of the retainer 40 and the receiving recess 42B is at a rear side with respect to the inserting direction ID of the retainer 40. The receiving portions 42A, 42B are partitioned by an interfering portion 48 that is engageable with the engaging protrusion 19. Accordingly, the engaging protrusion 19 can engage the receiving recess 42A for holding the retainer 40 at the partial locking position 1P while the pushable portion 41 projects sideways at one side surface of the female housing 10. The retainer 40 can be pushed further in the inserting direction ID so that the interfering portion 48 resiliently moves over the engaging protrusion 19. Thus, the engaging protrusion 19 engages the receiving recess 42B, and holds the retainer 40 at the full locking position 2P with the pushable portion 41 fit in the opening 17. An escaping hole 49 in the bottom wall 44 provides an area of resilient deformation when the interfering portion 48 moves over the engaging protrusion 19. The pushable portion 41 is configured to close the opening 17, and a guiding surface 41A corresponding to the jig guiding surface 18 is formed on the inner surface of the pushable portion 41.

Figure 1:
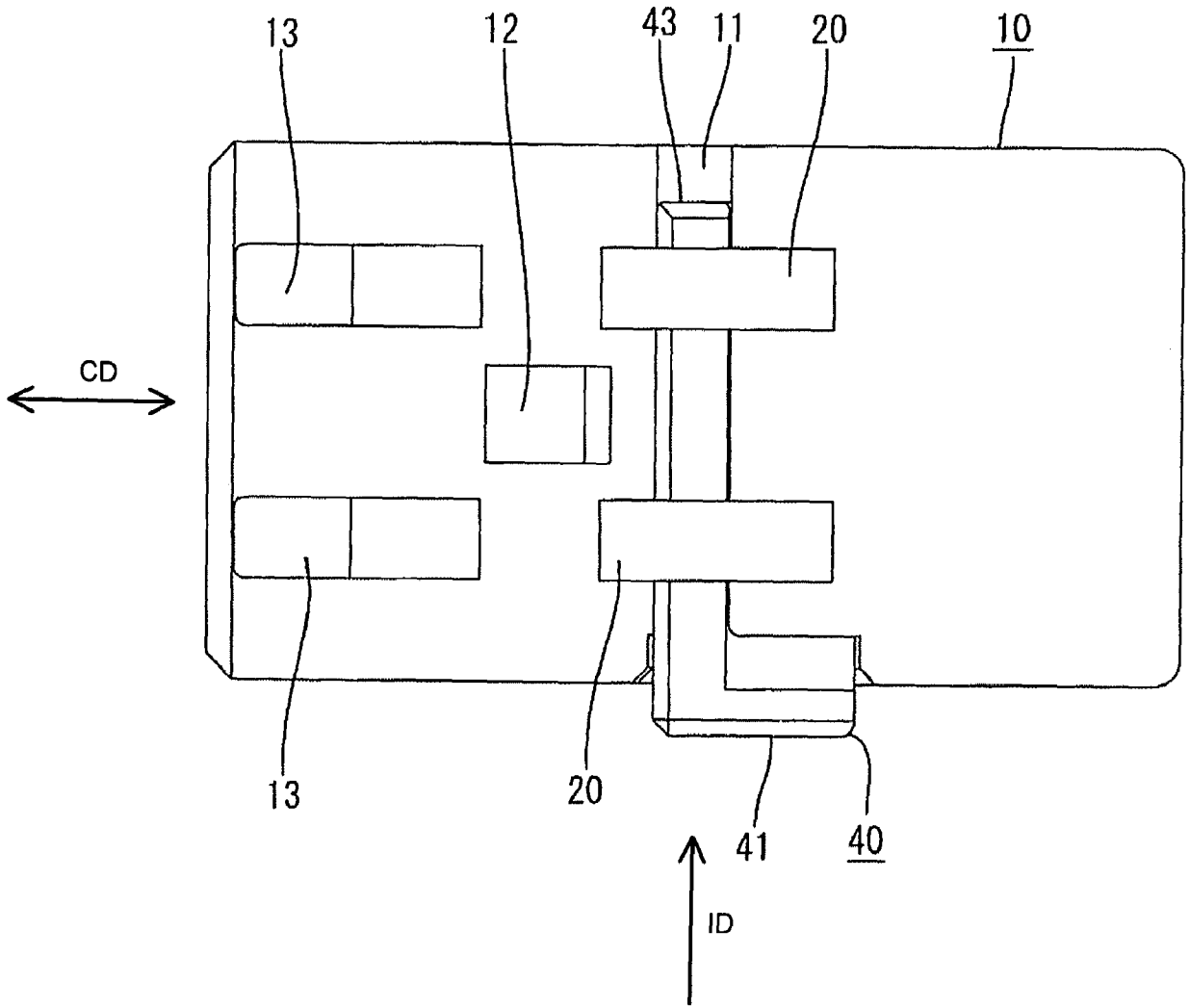
FIG. 1 is a plan view of a female housing according to one embodiment of the invention.
Figure 2:
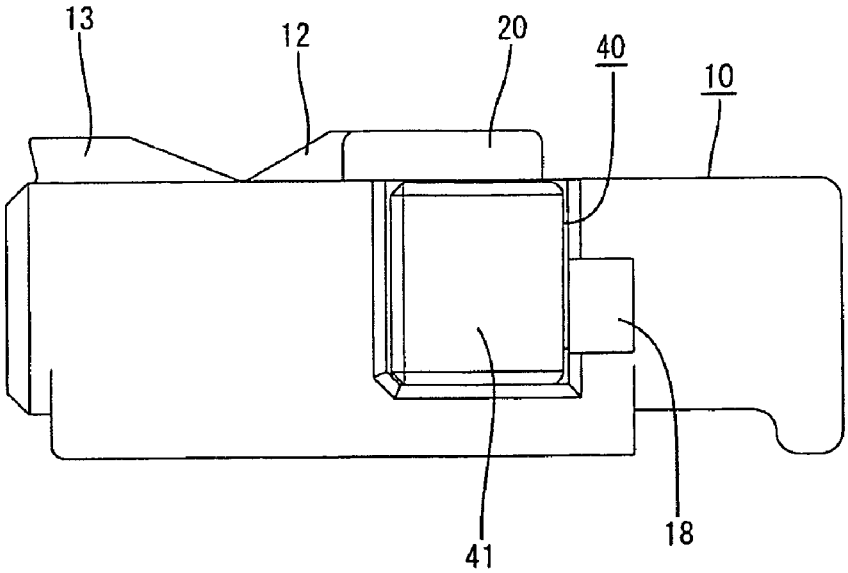
FIG. 2 is a right side view of the female housing.
Figure 3:
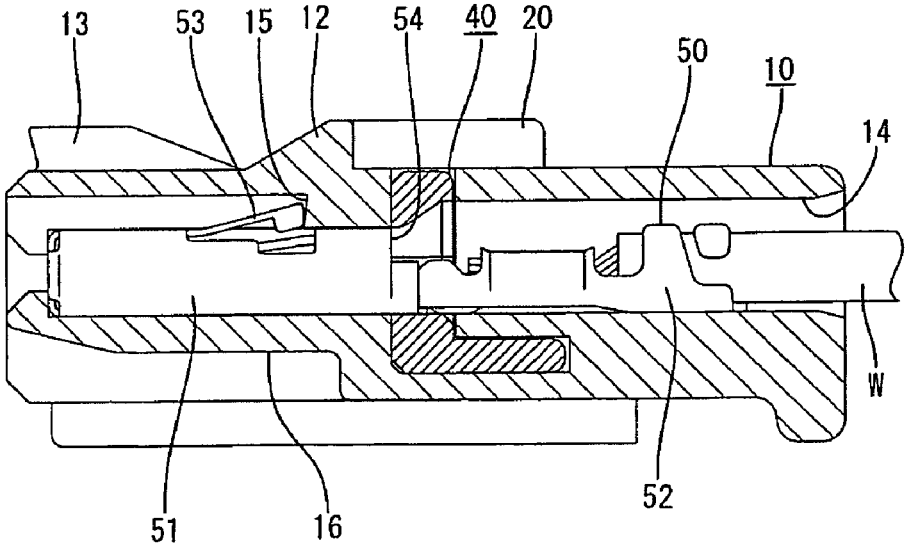
FIG. 3 is a side view in section of the female housing.

As shown in FIG. 1, two reinforcements 20 are provided on the upper surface of the female housing 10 and extend substantially perpendicularly across over the opening defined by the retainer mount hole 11. Each reinforcement 20 is a substantially rectangular column that extends in forward and backward directions FBD along the connecting and separating directions CD of the housings 10, 30. The reinforcements 20 are spaced apart along the width direction WD and located right behind the pressing portions 13. The reinforcements 20, when viewed from the front, are on the planes of projection of the pressing portions 13. Additionally, the reinforcements 20 have substantially the same height and width as the pressing portions 13. The pressable portions 72 of the pressable arms 38 fit between the reinforcements 20 and the pressing portions 13 when the two housings 10, 30 are connected properly.

The retainer 40 is inserted sideways into the retainer mount hole 11 of the female housing 10 along the inserting direction ID and substantially normal to the connecting direction CD. The engaging protrusion 19 of the female housing 10 then fits into the receiving portion 42A for holding the retainer 40 at the partial locking position 1P as shown in FIG. 7(A). Subsequently, the female terminal fittings 50 are inserted into the cavities from behind. The female terminal fittings 50 are inserted without interfering with the locking projections 47 and are locked partly by the locks 53 when the terminal fitting 50 reaches a proper insertion position.

The retainer 40 then is pushed further in the inserting direction ID. As a result, the engaging protrusion 19 resiliently moves over the interfering portion 48 and fits into the receiving portion 42B to hold the retainer 40 at the full locking position 2P. The locking projections 47 enter the cavities 14 to engage the jaws 54 of the female terminal fittings 50 so that the female terminal fittings 50 are locked fully. In should be understood that the female terminal fittings 50 may be locked only by the retainer 40 according to the invention.

Figure 13A:
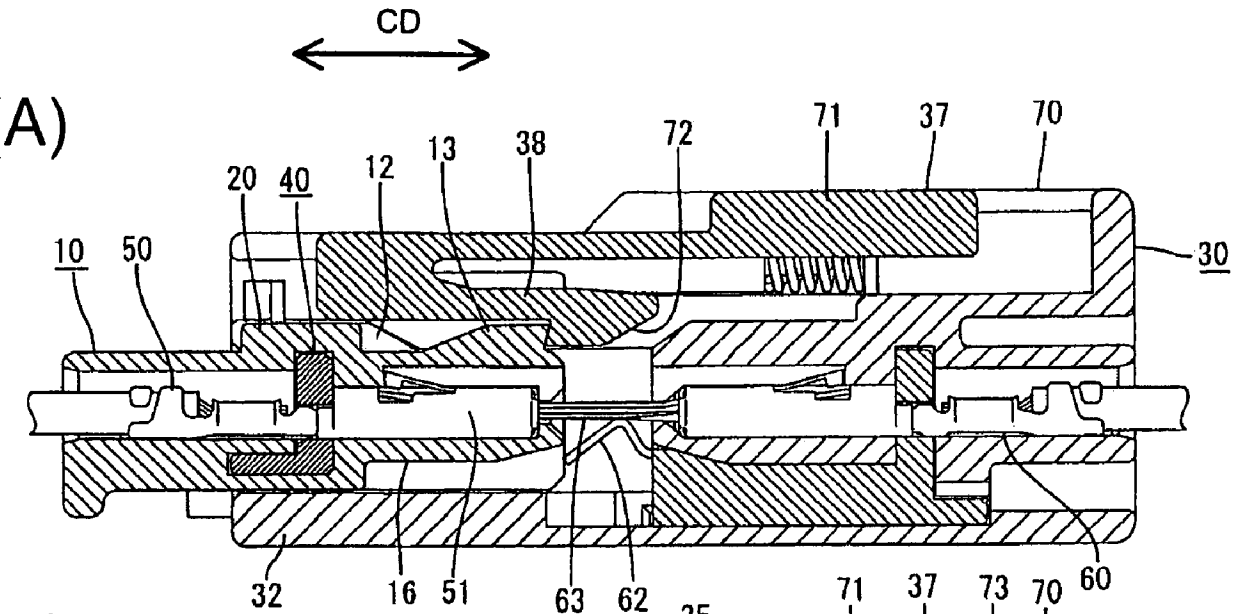
FIG. 13(A) is a side view in section showing a state where the pressing portions are pressing the pressable portions and FIG. 13(B) is a side view in section showing a state where a lock arm is held in contact with a lock portion.

Subsequently, the unit 70 is assembled with the male housing 30 and the slider 37 is set at the initial position. The female housing 10 then is fit in the connecting direction CD into the receptacle 32 of the male housing 30 to bring the pressing portions 13 into contact with the pressable portions 72, as shown in FIG. 12(A). The pressable portions 72 are pressed by the pressing portions 13, as shown in FIG. 13(A), when the connection progresses further. Thus, the slider 37 is moved back from the initial standby position while resiliently compressing the compression coil springs 73 and progressively accumulating a biasing force.

The connecting operation could be stopped halfway due to an operator's misunderstanding or the like. Thus, the biasing force accumulated in the compression coil springs 73 is released, and the pressable portions 72 push the pressing portions 13 back to forcibly separate the two housings 10, 30. Thus, the operator understands that the housings 10, 30 are connected only partly and, accordingly, a situation where the two housings 10, 30 are left only partly connected can be avoided.

Figure 13B:
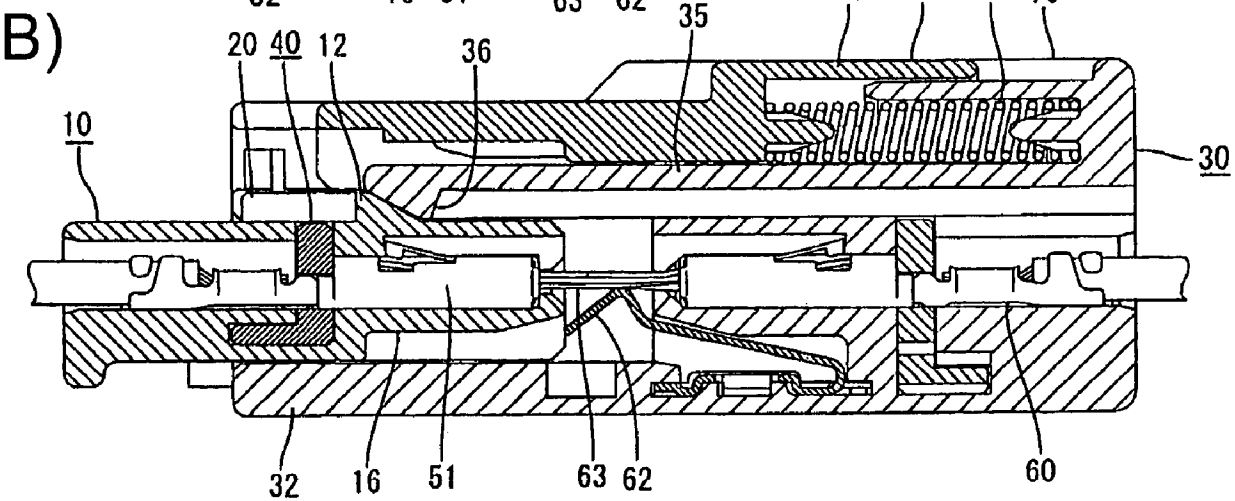
Figure 14A:
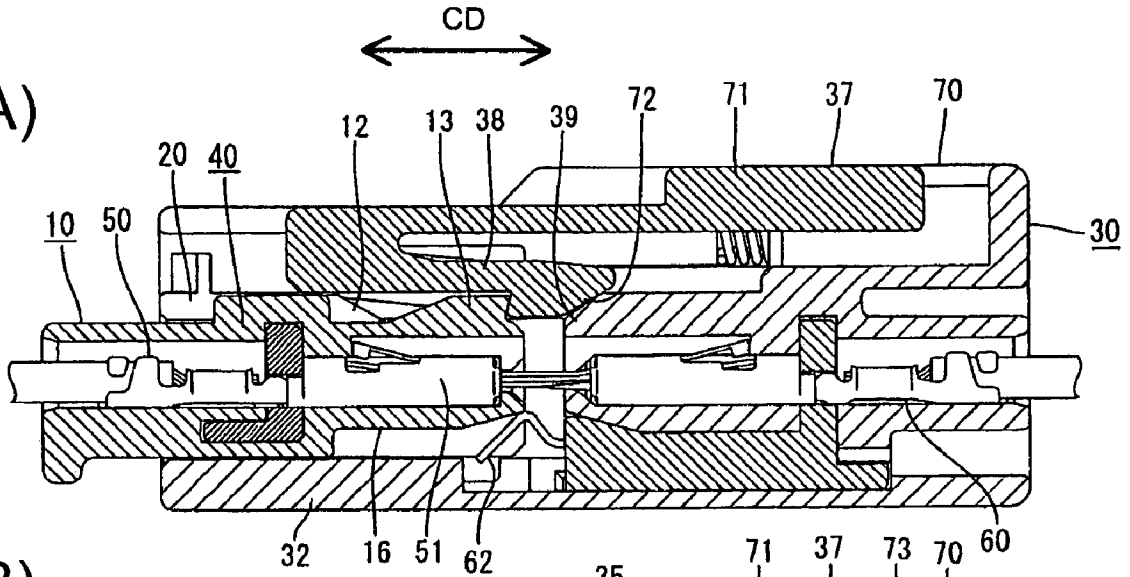
FIG. 14(A) is a side view in section showing a state where the pressable portions are held in contact with disengagement guiding portions and FIG. 14(B) is a side view in section showing a state where the lock arm is resiliently deformed.
Figure 14B:
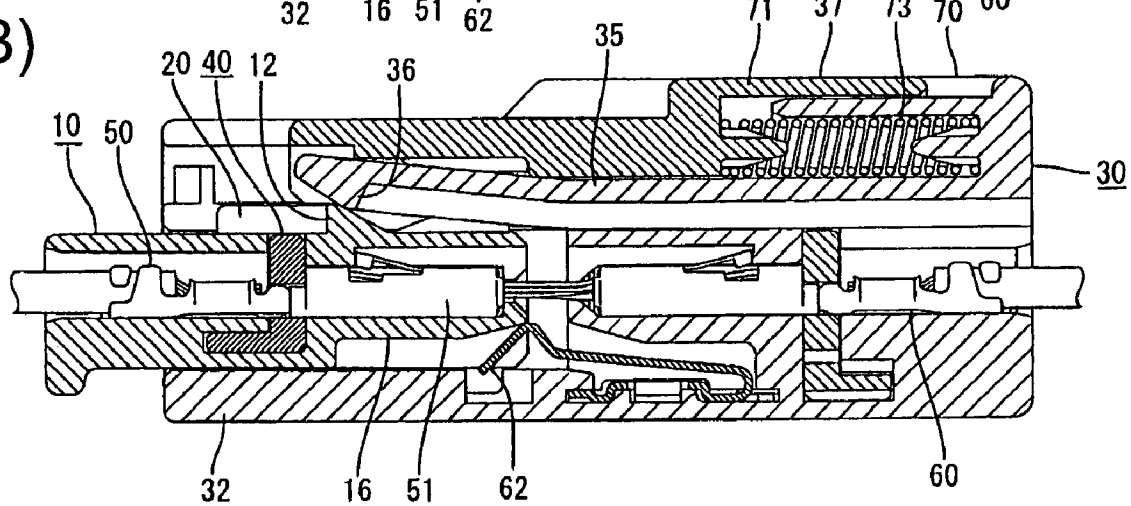
Figure 15A:
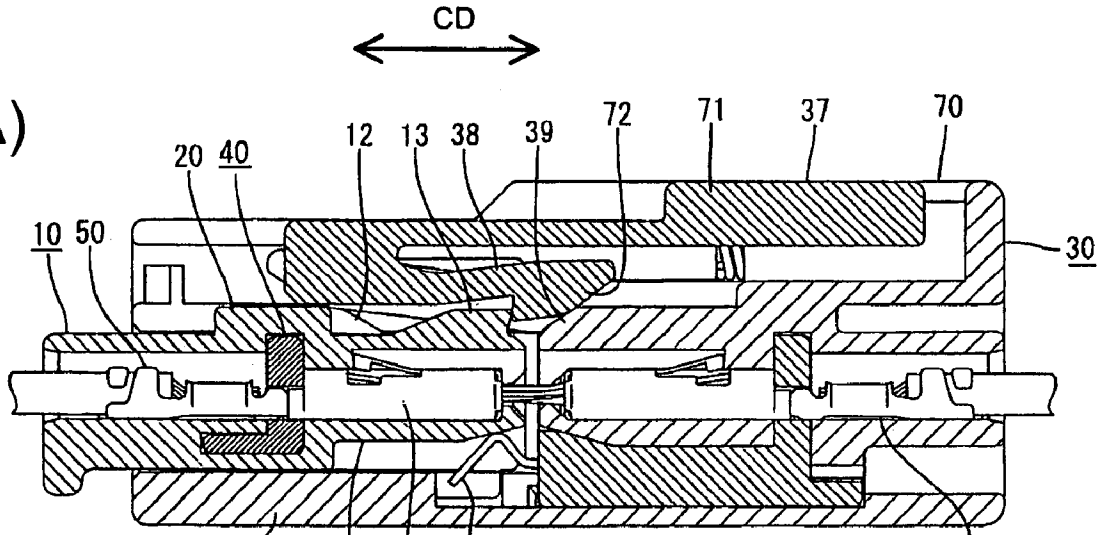
FIG. 15(A) is a side view in section showing a state where the pressable portions are resiliently deformed and FIG. 15(B) is a side view in section showing a state where the lock arm is further resiliently deformed.
Figure 15B:
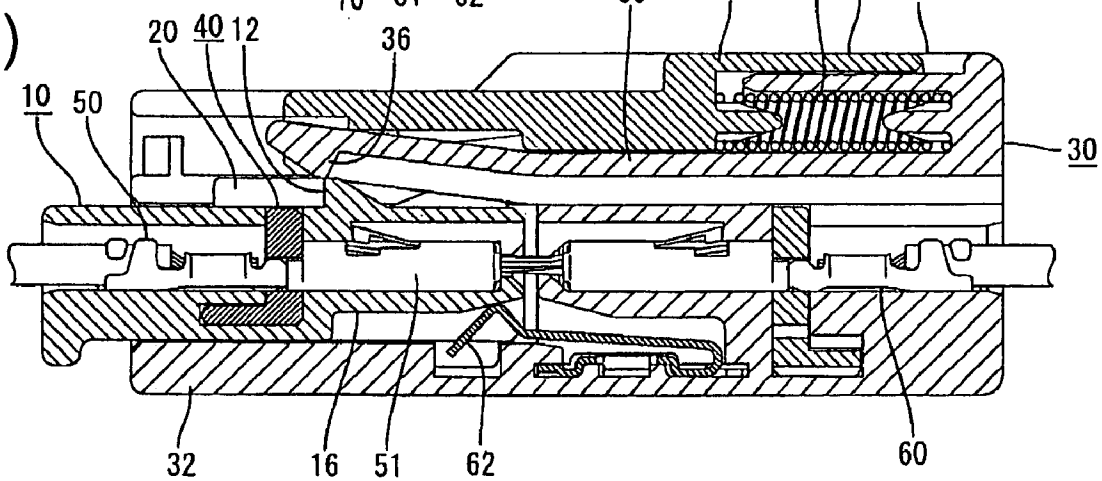

The connection progresses to the state of FIG. 13(B) where the lock projection 36 of the lock arm 35 contacts the front surface of the lock 12. Further insertion causes the lock arm 35 to deform, and the lock projection 36 moves onto the lock 12 as shown in FIG. 14(B). On the other hand, as shown in FIG. 15(A), the pressable portions 72 move onto the disengagement guiding portions 39 to deform the pressable arms 38. Further, the resilient contact pieces 62 of the shorting terminal 61 enter the freeing grooves 16 of the female housing 10 and are pushed down away from the respective terminal fittings 60 by the peripheral edges of the freeing grooves 16. As a result, the resilient contact pieces 62 move away from the tabs 63 to free the two male terminal fittings 60 from the shorted state.

Figure 16A:
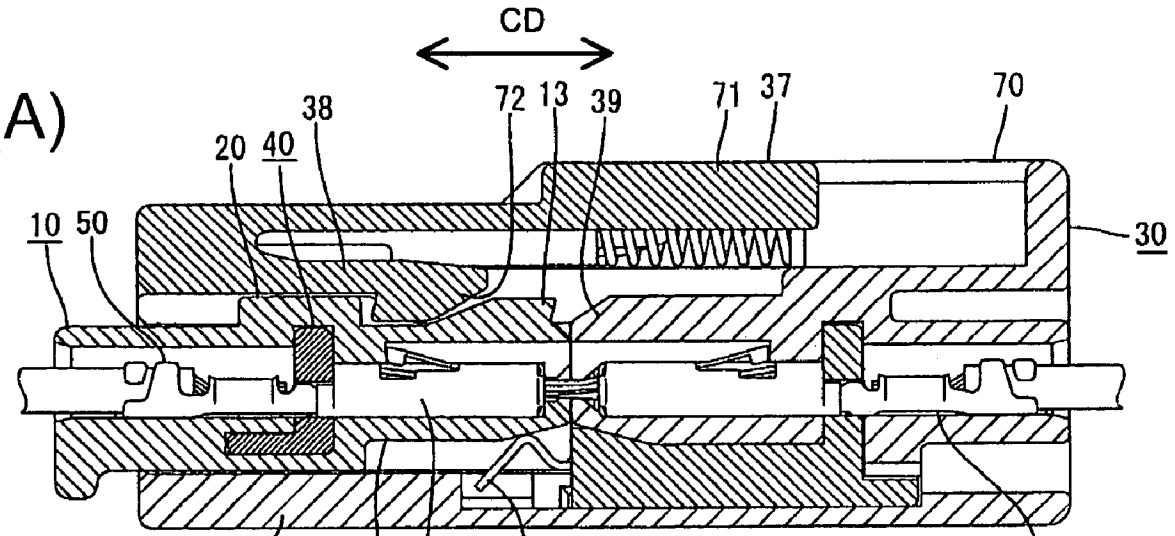
FIG. 16(A) is a side view in section showing a state where the two housings are properly connected and a slider reaches an initial position and FIG. 16(B) is a side view in section showing a state where the two housings are properly connected and the lock arm is engaged with the lock portion.
Figure 16B:
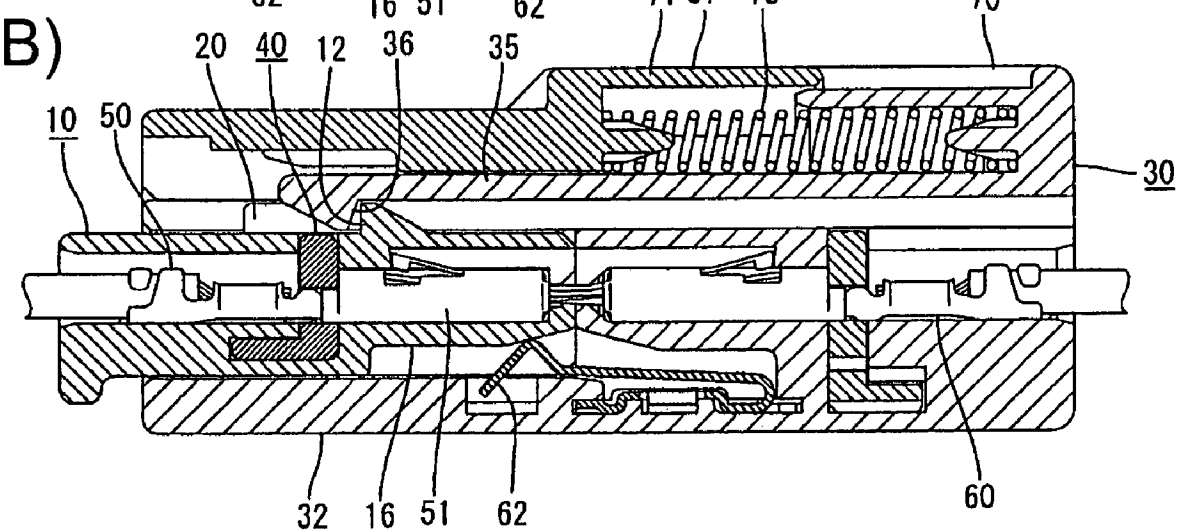

The lock projection 36 of the lock arm 35 moves over the lock 12 when the housings 10, 30 are connected properly and the lock arm 35 is restored resiliently to engage the lock projection 36 with the lock 12, as shown in FIG. 16(B). Further, the disengagement guides 39 disengage the pressable portions 72 from the pressing portions 13 when the housings 10, 30 are connected properly. Thus, the biasing force of the compression coil spring 73 is released and moves the slider 37 forward to the initial position. Then, the pressable portions 72 fit between the pressing portions 13 and the reinforcements 20, as shown in FIG. 16(A). Thus, the pressable arms 38 are restored substantially to their natural state. The pressing portions 13 are hidden behind the reinforcements 20 in the connecting process when being viewed from front. Thus, there is no possibility that the pressing portions 13 interfere with the opening edge and the inner surface of the receptacle 32.

As described above, the reinforcements 20 are substantially normal to the opening of the retainer mount hole 11 in the upper surface of the female housing 10 and cross over the retainer mount hole 11. Thus, the reinforcements 20 reinforce the female housing 10 and the female housing 10 will not deform. Further, it is not necessary to close the upper surface of the female housing 10 to provide the female housing 10 with a sufficient strength. Thus, the thickness of the female housing 10 is reduced by as much as the wall required to close the upper surface, which leads to miniaturization.

The female housing 10 is fit in the receptacle 32 of the male housing 30, and the pressing portions 13 on the female housing 10 engage the pressable portions 72 of the slider 37 in this process. The reinforcements 20 and the pressable portions 13 are arranged one after the other along a connecting direction CD and the reinforcements 20 are on the planes of projection of the pressable portions 13. Therefore, the reinforcements 20 will not interfere with the opening edge and the inner surface of the receptacle 32. As a result, the receptacle 32 does not need separate escapes for the reinforcements 20, which could weaken the female housing 10.

The invention is not limited to the above described embodiment. For example, the following embodiments are also embraced by the scope of the invention as defined by the claims. Other changes also can be made without departing from the scope of the invention as defined by the claims.

The opposite side surfaces of the female housing face each other along the inserting direction ID of the retainer and the reinforcements are on the upper surface of the female housing. However, the upper and lower surfaces of the female housing may face each other along the inserting direction ID of the retainer and the reinforcements may be on a side surface.

The reinforcements cross the opening of the retainer mount hole substantially normal to the opening in the foregoing embodiment. However, the reinforcements can cross over the opening of the retainer mount hole in a direction intersecting the opening according to the invention.

The reinforcements may cross over a retainer mount hole of the male housing according to the present invention.

The number of the reinforcements can be changed.

What is claimed is:

1. A connector, comprising:

a housing formed with cavities for receiving terminal fittings, and a retainer mount hole extending transversely across the housing and communicating with the cavities, the retainer mount hole being open in two opposite side surfaces of the housing and an adjacent surface that is adjacent to both of the two opposite side surfaces;

a retainer insertable into the retainer mount hole to lock the terminal fittings in the cavities; and at least one reinforcement on the adjacent surface and crossing the retainer mount hole.

2. A connector, comprising:

a housing formed with cavities for receiving terminal fittings, and a retainer mount hole extending transversely across the housing and communicating with the cavities, the retainer mount hole being open in at least one side surface of the housing and an adjacent surface, the housing having a front end for mating with a mating housing along a connecting direction, a pressing portion projecting from the adjacent surface of the housing in proximity to the front end for pressing a slider in the mating housing:

a retainer insertable into the retainer mount hole to lock the terminal fittings in the cavities; and at least one reinforcement on the adjacent surface and crossing the retainer mount hole, the reinforcement being rearward of the pressing portion and substantially aligned with the pressing portion along the connecting direction of the housings.

3. The connector of claim 2, wherein the reinforcement and the pressing portion lie substantially in a common plane along the connecting direction of the housings.

4. The connector of claim 2, wherein the retainer mount hole is open in two opposed side surfaces of the housing, the adjacent surface being adjacent to both of the side surfaces.

5. A connector assembly, comprising:

a housing formed with cavities for receiving terminal fittings, and a retainer mount hole extending transversely across the housing and communicating with the cavities, the retainer mount hole being open in at least one side surface of the housing and an adjacent surface;

a retainer insertable into the retainer mount hole to lock the terminal fittings in the cavities;

a mating housing having a receptacle for receiving the housing along a connecting direction;

a slider assembled into the mating housing and movable along the connecting direction of the housings;

a biasing means between the mating housing and the slider for accumulating a biasing force for separating the housings; and at least one reinforcement on the adjacent surface and crossing the retainer mount hole.

6. The connector assembly of claim 5, wherein:

the slider has at least one pressable portion exposed at an inner surface of the receptacle, a pressing portion projects from a surface of the housing and disposed for pressing the pressable portion while connecting the housings.

7. The connector assembly of claim 6, wherein the pressing portion and the reinforcement are arranged one after the other along the connecting direction of the two housings.

8. The connector assembly of claim 7, wherein the reinforcement is arranged on a plane of projection of the pressing portion when viewed along the connecting direction of the two housings.

9. The connector assembly of claim 7, wherein when the two housings are properly connected, the pressing portion and the pressable portion are freed from the pressed state by at least one disengagement guide provided in the mating housing so that a movement of the slider permitted to release the biasing force of the biasing means.

10. The connector assembly of claim 6, wherein the pressing portion is substantially hidden behind the reinforcement during connection, so that the pressing portions cannot interfere with an opening edge and an inner surface of the receptacle.

11. The connector assembly of claim 6, wherein the pressable portion is fittable between the reinforcement and the pressing portion when the two housings are properly connected.

12. A connector assembly of claim 5, wherein the at least one reinforcement comprises two substantially parallel reinforcements.

13. A connector, comprising:

a housing formed with cavities for receiving terminal fittings, and a retainer mount hole extending transversely across the housing and communicating with the cavities, the retainer mount hole being open in at least one side surface of the housing and an adjacent surface that is perpendicular to the side surface;

a retainer insertable into the retainer mount hole to lock the terminal fittings in the cavities; and at least one reinforcement on the adjacent surface and crossing the retainer mount hole.

14. The connector of claim 13, wherein the retainer mount hole is open in two opposite side surfaces of the housing, each of the opposite side surfaces of the housing being align substantially perpendicular to the adjacent surface on which the reinforcement is formed.

15. The connector of claim 13, wherein the retainer is insertable along a retainer inserting direction, the reinforcement crossing the retainer mount hole in a direction substantially perpendicular to the retainer inserting direction.

16. The connector assembly of claim 13, wherein the at least one reinforcement comprises two substantially parallel reinforcements.

* * * * *